US010677434B2

(12) United States Patent
Li

(10) Patent No.: US 10,677,434 B2
(45) Date of Patent: Jun. 9, 2020

(54) LAMP CAPABLE OF CONVENIENTLY REALIZING REGULATION OF POLY FLOODLIGHT STATE

(71) Applicant: SYSMAX INNOVATIONS CO., LTD., Guangzhou (CN)

(72) Inventor: Wenjie Li, Guangzhou (CN)

(73) Assignee: SYSMAX INNOVATIONS CO., LTD. (CN)

( * ) Notice: Subject to any disclaimer, the term of this patent is extended or adjusted under 35 U.S.C. 154(b) by 0 days.

(21) Appl. No.: 16/377,534

(22) Filed: Apr. 8, 2019

(65) Prior Publication Data

US 2019/0360674 A1 Nov. 28, 2019

(30) Foreign Application Priority Data

May 23, 2018 (CN) ..... 2018 2 0778007 U

(51) Int. Cl.
*F21V 23/00* (2015.01)
*F21V 23/04* (2006.01)
(Continued)

(52) U.S. Cl.
CPC ..... *F21V 23/003* (2013.01); *F21V 21/02* (2013.01); *F21V 23/04* (2013.01); *F21S 8/035* (2013.01)

(58) Field of Classification Search
CPC ..... F21V 13/00; F21V 13/02; F21V 13/04; F21V 13/045; F21V 13/06; F21V 14/00; F21V 14/02; F21V 14/025; F21V 14/04; F21V 14/045; F21V 23/0003; F21V 23/04; F21V 23/0414; F21V 23/0428; F21S 8/003
See application file for complete search history.

(56) References Cited

U.S. PATENT DOCUMENTS 10,113,735 B2 * 10/2018 Emerson ..... F21V 29/58
10,267,501 B1 * 4/2019 Lowchareonkul .. F21V 23/0492
(Continued)

FOREIGN PATENT DOCUMENTS

CN 101793349 8/2010
CN 101793349 A 8/2010
(Continued)

*Primary Examiner* — Jason Crawford
(74) *Attorney, Agent, or Firm* — Schmeiser, Olsen & Watts, LLP

(57) ABSTRACT

A lamp is disclosed, which includes a barrel, a light emitting component, a switching assembly and a circuit component. The light emitting includes a lamp panel group, multiple far-shot lamp beads and a near-shot lamp bead. The circuit component includes a master control circuit, a switching circuit and a circuit for regulating a poly floodlight state; the switching circuit is connected with the switching assembly and the master control circuit, and transmits triggering signals, which characterize that the switching assembly is pressed down or released, to the master control circuit; the circuit for regulating a poly floodlight state is connected with the master control circuit and the light emitting component, and regulates luminous power of the far-shot lamp beads and the near-shot lamp bead in the light emitting component. And the lamp is capable of conveniently realizing regulation of a poly floodlight state.

10 Claims, 5 Drawing Sheets

(51) Int. Cl.
*F21V 21/02* (2006.01)
*F21S 8/00* (2006.01)

(56) References Cited

U.S. PATENT DOCUMENTS

| | | | | |
|---|---|---|---|---|
| 2007/0183152 | A1* | 8/2007 | Hauck | B60Q 1/2607 362/249.07 |
| 2009/0109664 | A1* | 4/2009 | Halasz | F21L 4/00 362/190 |
| 2009/0207591 | A1* | 8/2009 | Kumthampinij | F21L 4/04 362/105 |
| 2009/0323317 | A1* | 12/2009 | Spartano | F21V 14/065 362/105 |
| 2012/0182748 | A1* | 7/2012 | McCaslin | A42B 3/044 362/473 |
| 2014/0070699 | A1* | 3/2014 | Genthon | H05B 33/0845 315/82 |
| 2014/0146552 | A1* | 5/2014 | Hui | F21V 23/0442 362/473 |
| 2015/0305111 | A1* | 10/2015 | Bortolotti | F21L 4/00 315/152 |
| 2016/0025283 | A1* | 1/2016 | Chen | F21L 4/00 362/191 |
| 2018/0231234 | A1* | 8/2018 | Bian | F21V 23/0414 |
| 2018/0249563 | A1* | 8/2018 | Alexander | H05B 37/0272 |

FOREIGN PATENT DOCUMENTS

| | | | |
|---|---|---|---|
| CN | 101799145 | A | 8/2010 |
| CN | 105757615 | A | 7/2016 |
| CN | 207219099 | U | 4/2018 |

* cited by examiner

LAMP CAPABLE OF CONVENIENTLY REALIZING REGULATION OF POLY FLOODLIGHT STATE

CROSS-REFERENCE TO RELATED APPLICATIONS

This application claims priority to Chinese Application No. CN201820778007.X having a filing date of May 23, 2018, the entire contents of which are hereby incorporated by reference.

FIELD OF TECHNOLOGY

The following relates to the field of lamps, in particular to lamps capable of conveniently realizing regulation of a poly floodlight state.

BACKGROUND

Along with rapid development of science and technology, people's requirements on lamps are also increasingly high, they not only hope to control the turning on/off of lamps, but also hope that a poly floodlight state of light source radiation can be conveniently regulated along with a change in an operational environment.

The existing lamps which can realize regulation of a poly floodlight state generally include a light emitting component, an inner sleeve, an outer sleeve and a lens; the light emitting component is arranged inside the inner sleeve, the outer sleeve is sleeved outside the inner sleeve, and the outer sleeve is further provided with a lens which has a focal power, then a relative distance between a light emitting element and the lens is adjusted through pushing and pulling or rotating the outer sleeve, so as to change a projection path of the light emitting component, and realize regulation of a poly floodlight state of a light source.

However, in order to realize relative movement between the inner sleeve and the outer sleeve, a gap necessarily exists between the inner sleeve and the outer sleeve, while the existence of a gap will inevitably influence leakproofness of lamps and regulation stability. In addition, the manners of regulating a poly floodlight state through rotating and stretching are very inconvenient with a poor experience effect.

SUMMARY

An aspect relates to a lamp which can conveniently realize regulation of a poly floodlight state, and the lamp has the advantages of ensuring leakproofness and stability of the lamp and being capable of conveniently realizing regulation of a poly floodlight state of light beams.

A lamp comprising: a barrel, a light emitting component, a switching assembly and a circuit component; wherein the light emitting component and the circuit component are arranged inside the barrel, the switching assembly is embedded on the barrel, and the light emitting component and the switching assembly are both electrically connected with the circuit component;

the light emitting component comprises a lamp panel group, multiple far-shot lamp beads and a near-shot lamp bead; the multiple far-shot lamp beads are arranged on the lamp panel group, and are uniformly distributed on the periphery of the light panel group; and the near-shot lamp bead is arranged a the center of the lamp panel group;

the circuit component comprises a master control circuit, a switching circuit and a circuit for regulating a poly floodlight state; the switching circuit is connected with the switching assembly and the master control circuit, and transmits triggering signals, which characterize that the switching assembly is pressed down or released, to the master control circuit; the circuit for regulating a poly floodlight state is connected with the master control circuit and the light emitting component, and regulates luminous power of the far-shot lamp beads and the near-shot lamp bead in the light emitting component.

Compared with the known art, in embodiments of the present invention, through designing a near-shot lamp bead, multiple far-shot lamp beads and a hardware circuit, under the premise of ensuring leakproofness and stability of lamps, a luminous power of a light emitting component can be conveniently regulated through pressing keys, thereby conveniently realizing regulation of a poly floodlight state.

Further, the switching assembly comprises at least two keys, and the switching circuit comprises at least two groups of key activation circuits, a conductive circuit and a first triode; each group of key activation circuits corresponds to one key, and each group of key activation circuits comprises a first diode and a first schottky diode which are in series-opposing connection; a positive electrode end of the first diode is connected with the master control circuit, and a positive electrode end of the first schottky diode is connected with an external power line via the first triode; the conductive circuit is connected with the positive electrode end of the first schottky diode, and is connected to the first triode, and the conductive circuit comprises a first field-effect transistor, a second field-effect transistor and a first resistor which are connected in parallel; when one of the keys is pressed down, one end of the key is connected to a negative electrode end of the first diode and a negative electrode end of the first schottky diode, and another end of the key is grounded, so as to send triggering signals to the master control circuit.

Further, the circuit for regulating a poly floodlight state comprises a DCDC constant current drive circuit, a power regulating circuit for the near-shot lamp bead and a power regulating circuit for the far-shot lamp beads; the DCDC constant current drive circuit is connected with the master control circuit, such that an output current of the circuit for regulating a poly floodlight state keeps constant; a positive electrode end of the near-shot lamp bead is connected to the DCDC constant current drive circuit, the multiple far-shot lamp beads are connected in series with each other, and a positive electrode end of one of the far-shot lamp beads is connected to the DCDC constant current drive circuit; the power regulating circuit for the near-shot lamp bead comprises a first filter circuit, a third field-effect transistor and a fourth field-effect transistor; an input end of the first filter circuit is connected with a first PWM output end of the master control circuit, so as to receive signals for regulating a poly floodlight state of the master control circuit; a grid of the third field-effect transistor and a grid of the fourth field-effect transistor are both connected with an output end of the first filter circuit; a drain of the third field-effect transistor and a drain of the fourth field-effect transistor are both connected with a negative electrode end of the near-shot lamp bead; and a source of the third field-effect transistor and a source of the fourth field-effect transistor are both grounded; the power regulating circuit for the far-shot lamp beads comprises a second filter circuit, a fifth field-effect transistor and a sixth field-effect transistor; an input end of the second filter circuit is connected with a second PWM output end of the master control circuit, so as to receive signals for regulating a poly floodlight state of the master control circuit; a grid of the fifth field-effect transistor and a grid of the sixth field-effect transistor are both connected with an output end of the second filter circuit; a drain of the fifth field-effect transistor and a drain of the sixth field-effect transistor are both connected with a negative electrode end of the far-shot lamp beads; and a source of the fifth field-effect transistor and a source of the sixth field-effect transistor are both grounded.

Further, the lamp panel group comprises a first light panel and a second light panel, an accommodation groove is arranged in a center of the first light panel; the second light panel is arranged inside the accommodation groove; the multiple far-shot lamp beads are uniformly distributed on the periphery of the first light panel, and the near-shot lamp bead is arranged in a center of the second light panel.

Further, the barrel comprises a barrel body, an inner bracket, a rear cover, a fixed support, a support hinge, a lens and a head compression ring; the inner bracket is arranged inside the barrel body; the circuit component is fixed on the inner bracket, and is arranged behind the barrel body; the rear cover is arranged at a rear end of the barrel body, and is fixedly connected with the inner bracket; the fixed bracket is fixed on the barrel body via the bracket hinge, and is arranged at a rear end of the rear cover; the light panel group is arranged on the inner bracket, and is located in a middle part of the barrel body; the lens is fixedly connected with the inner bracket, and is located at a front part of the barrel body; and the head compression ring is fixed on a front end of the barrel body in a rotating manner.

Further, the lamp comprises a USB transmission line; the circuit component further comprises a USB interface circuit and a charging control circuit; the barrel body has a USB interface, and the USB transmission line is connected with the USB interface circuit through the USB interface; and the charging control circuit is connected with the master control circuit.

Further, the switching assembly comprises a bottom key group arranged at the bottom of the barrel body, and the bottom key group has a first key and a second key, which are connected with the switching circuit, at the front part and the rear part of the bottom key group respectively.

For a better understanding and implementation, embodiments of the present invention will be described in detail below in combination with accompanying drawings.

BRIEF DESCRIPTION OF THE DRAWINGS

Some of the embodiments will be described in detail, with references to the following Figures, wherein like designations denote like members, wherein.

DETAILED DESCRIPTION

Figure 1:
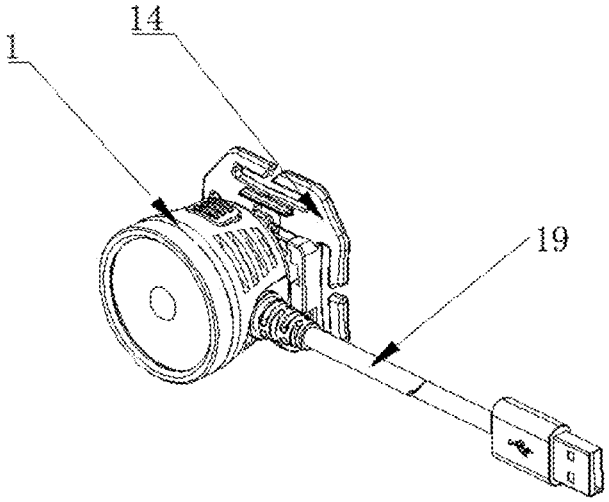
FIG. 1 is a structural schematic diagram of a lamp capable of conveniently realizing regulation of a poly floodlight state in embodiments of the present invention.
Figure 2:
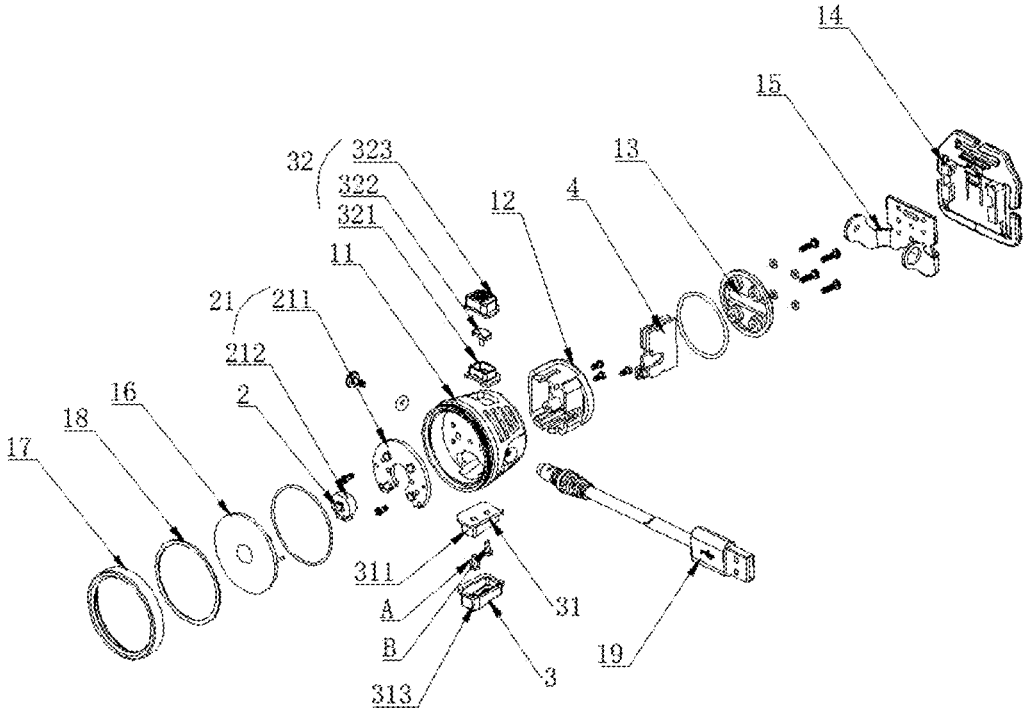
FIG. 2 is an exploded view of the lamp shown in FIG. 1.

Please refer to FIG. 1 to FIG. 2 simultaneously. FIG. 1 is a structural schematic diagram of a lamp capable of conveniently realizing regulation of a poly floodlight state in embodiments of the present invention; and FIG. 2 is an explosive view of the lamp shown in FIG. 1. A lamp capable of conveniently realizing regulation of a poly floodlight state includes a barrel 1, a light emitting component 2, a switching assembly 3 and a circuit component 4. The light emitting component 2 and the circuit component 4 are arranged inside the barrel 1, the switching assembly 3 is embedded on the barrel 1, and the light emitting component 2 and the switching assembly 3 are both electrically connected with the circuit component 4. Compared with the manner of switching regulation of a poly floodlight state through mechanical rotation and telescopic rotation in the known art, an invention point of embodiments of the present invention lies in that an output power of the light emitting component 2 is regulated through designing a circuit for regulating a poly floodlight state 43 and according to detection of a state when the switching assembly 3 is pressed downwards, thereby realizing regulation of a poly floodlight state of light rays emitted by the light emitting component 2. Specifically, the light emitting component 2 includes a lamp panel group 21, multiple far-shot lamp beads and a near-shot lamp bead; multiple far-shot lamp beads are arranged on the lamp panel group 21, and are uniformly distributed on the periphery of the light panel group 21; and the near-shot lamp bead is arranged in the center of the lamp panel group 21; and through regulating an output power of the multiple far-shot lamp beads and the near-shot lamp bead, regulation of light beams from a light focusing mode to a floodlight mode or from a floodlight mode to a light focusing mode is simulated. The circuit component 4 includes a master control circuit 41, a switching circuit 42 and a circuit for regulating a poly floodlight state 43. The switching circuit 42 is connected with the switching assembly 3 and the master control circuit 41, and transmits triggering signals, which characterize that the switching assembly 3 is pressed down or released, to the master control circuit 41; the circuit for regulating a poly floodlight state 43 is connected with the master control circuit 41 and the light emitting component 2, and regulates luminous power of the far-shot lamp beads and near-shot lamp bead in the light emitting component 2 according to signals for regulating a poly floodlight state transmitted by the master control circuit 41, so as to realize regulation of a poly floodlight state of light rays emitted by the light emitting component 2.

In the present embodiment, the light panel group 21 includes a first light panel 211 and a second light panel 212, an accommodation groove is arranged in the center of the first light panel 211; and the second light panel 212 is arranged inside the accommodation groove. Multiple far-shot lamp beads are uniformly distributed on the periphery of the first light panel 211, and the near-shot lamp bead is arranged in the center of the second light panel 212. The number of the far-shot lamp beads is four, and the four far-shot lamp beads are respectively a light emitting diode LED 2, a light emitting diode LED 3, a light emitting diode LED 4 and a light emitting diode LED 5 in sequence. The number of the near-shot lamp bead is one, and the near-shot lamp bead is a light emitting diode LED 1.

The barrel 1 includes a barrel body 11, an inner bracket 12, a rear cover 13, a fixed support 14, a support hinge 15, a lens 16 and a head compression ring 17. The inner bracket 12 is arranged inside the barrel body 11. The circuit component 4 is fixed on the inner bracket 12, and is arranged behind the barrel body 11. The rear cover 13 is arranged at a rear end of the barrel body 11, and is fixedly connected with the inner bracket 12. The fixed bracket 14 is fixed on the barrel body 11 via the bracket hinge 15, and is arranged at a rear end of the rear cover 13. The light panel group 21 is arranged on the inner bracket 12, and is located in the middle part of the barrel body 11. The lens 16 is fixedly connected with the inner bracket 12, and is located at a front part of the barrel body 11. The head compression ring 17 is fixed on a front end of the barrel body 11 in a rotating manner. Wherein the connections between the rear cover 13 and the inner bracket 12, between the circuit component 4 and the inner bracket 12, and between the lamp panel group 21 and the inner bracket 12 can be realized through screw spikes or other interconnecting pieces. In order to strengthen leakproofness of lamps, an O-shaped sealing ring can be additionally arranged at the connecting position between a periphery of the rear cover 13 and the inner bracket 12 and between the periphery of the lamp panel group 21 and the barrel body 11. A PET gasket 18 can be additionally arranged between the periphery of the lens 16 and the barrel body 11.

Figure 3:
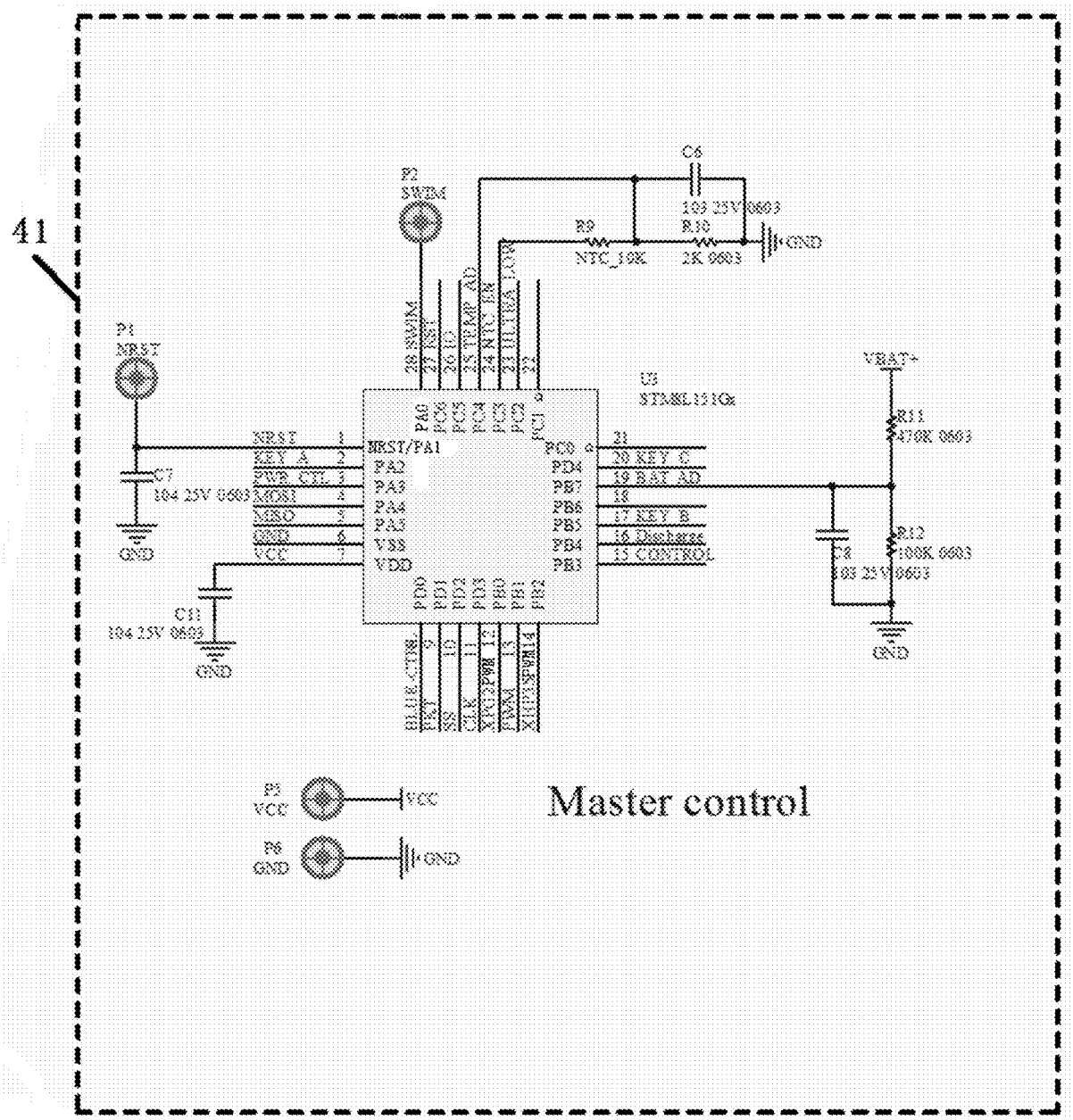
FIG. 3 is a circuit structural schematic diagram of a master control circuit of embodiments of the present invention.
Figure 4:
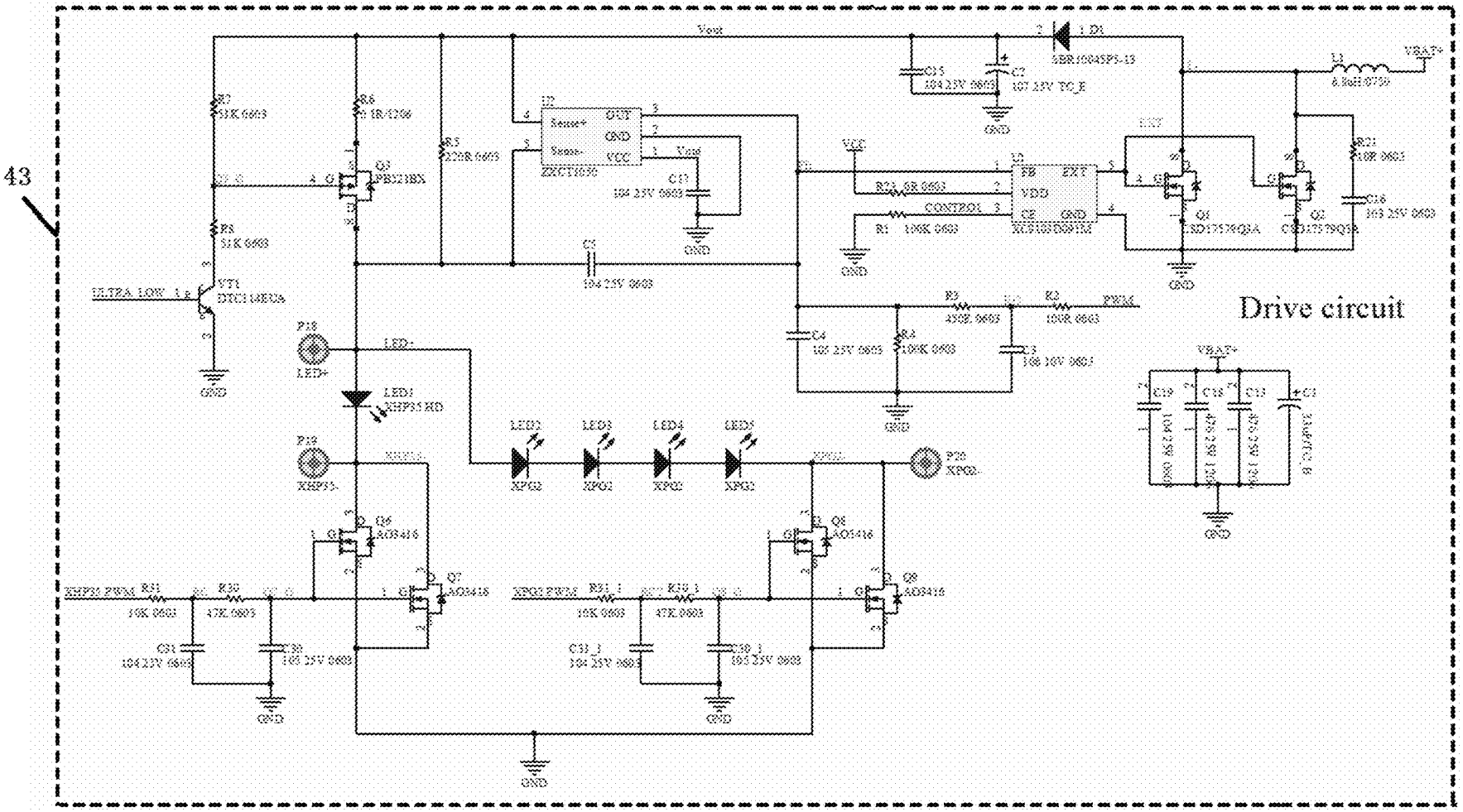
FIG. 4 is a circuit structural schematic diagram of a circuit for regulating a poly floodlight state of embodiments of the present invention.
Figure 5:
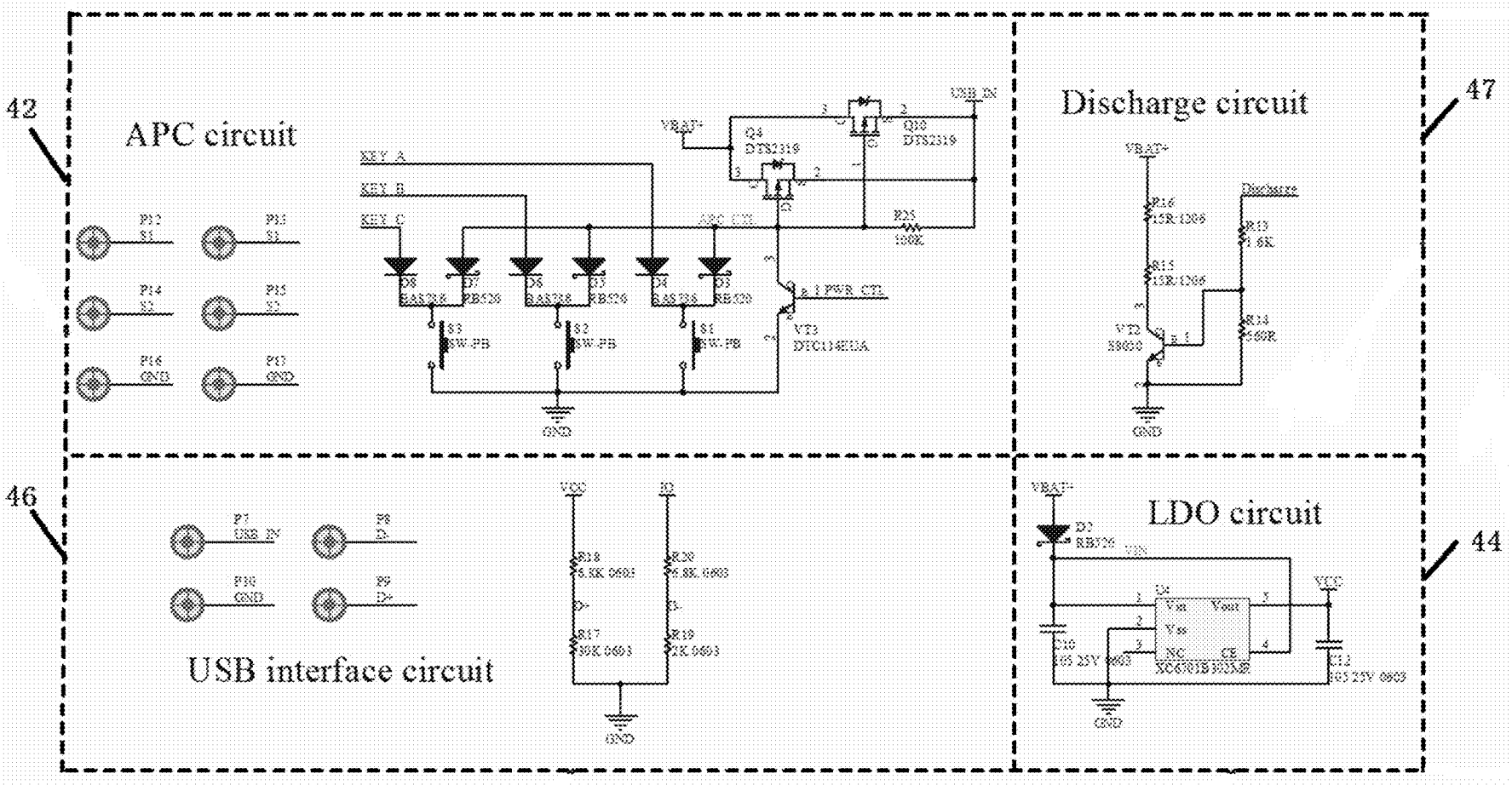
FIG. 5 is a circuit structural schematic diagram of a switching circuit, a USB interface circuit, a voltage stabilizing circuit and a charging control circuit of embodiments of the present invention.
Figure 6:
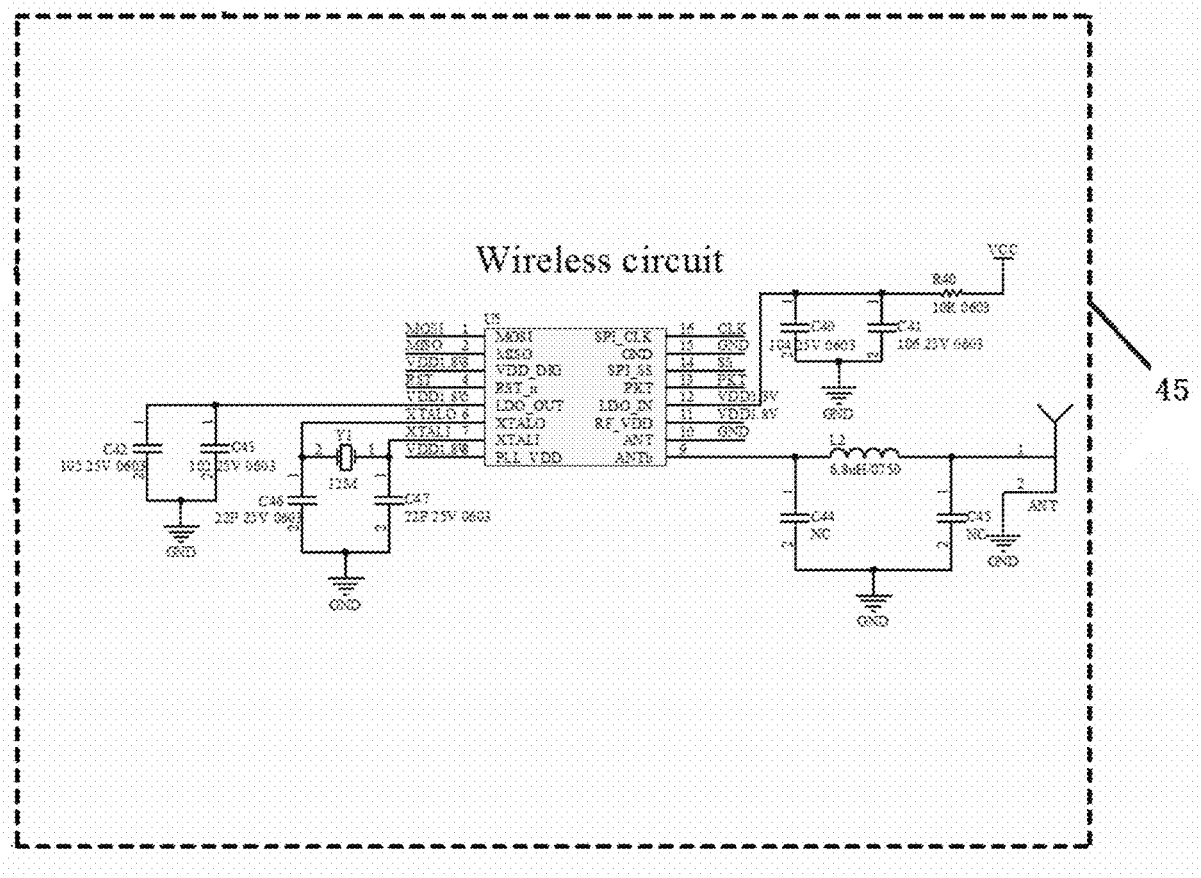
FIG. 6 is a circuit structural schematic diagram of a wireless receiving circuit of embodiments of the present invention.

Please refer to FIG. 3 to FIG. 6 simultaneously. FIG. 3 is a circuit structural schematic diagram of a master control circuit of embodiments of the present invention; FIG. 4 is a circuit structural schematic diagram of a circuit for regulating a poly floodlight state of embodiments of the present invention; FIG. 5 is a circuit structural schematic diagram of a switching circuit, a USB interface circuit, a voltage stabilizing circuit and a charging control circuit of embodiments of the present invention; and FIG. 6 is a circuit structural schematic diagram of a wireless receiving circuit of embodiments of the present invention.

In order to convert external power voltage into circuit voltage at which each circuit operates, the circuit component 4 further includes a voltage stabilizing circuit 44. The voltage stabilizing circuit 44 includes a second schottky diode D2 and a voltage stabilizing chip U4. An input end VIN of the voltage stabilizing chip U4 is connected to a power voltage via the second schottky diode D2, and the input end VIN of the voltage stabilizing chip U4 is also grounded via a capacitor C10. An input/output end CE of the voltage stabilizing chip U4 is connected to the input end VIN of the voltage stabilizing chip U4; and the output end VOUT of the voltage stabilizing chip U4 is a circuit voltage VCC, and the output end VOUT of the voltage stabilizing chip U4 is grounded via a filter capacitor C12. In the present embodiment, the model of the voltage stabilizing chip U4 is XC6701B302MR.

The master control circuit 41 includes a single chip microcomputer. An input/output end PB7 of the single chip microcomputer is connected with a power voltage via a voltage dropping resistor R11, and the input/output end PB7 of the single chip microcomputer is also grounded via a capacitor C8 and a resistor R12 which are connected in parallel. An input/output end PA2, an input/output end PD4 and an input/output end PB5 of the single chip microcomputer are respectively connected with the switching circuit 42, so as to receive triggering signals sent by the switching circuit 42. An input/output end PB3, an input/output end PC2, the input/output end PB1, an input/output end PB0 and an input/output end PB2 of the single chip microcomputer are all connected with the circuit for regulating a poly floodlight state 43, and the DCDC constant current drive circuit is enabled by the input/output end PB3. The input/output end PC2 controls the on and off of a tactic mode; and a PWM control signal is sent to the circuit for regulating a poly floodlight state 43 through the input/output end PB1, so as to adjust the magnitude of the current of the circuit for regulating a poly floodlight state 43. The input/output end PB0 serves as a first PWM output end of the master control circuit 41, and the input/output end PB2 serves as a second PWM output end of the master control circuit 41. Two paths of PWM signals are output to the circuit for regulating a poly floodlight state 43 through the input/output end PB0 and the input/output end PB2, so as to control luminous power of the far-shot lamp beads and the near-shot lamp bead.

The switching assembly 3 includes a bottom key group 31 and a top key group 32. The bottom key group 31 is arranged at the bottom of the barrel body 11, specifically, the bottom key group 31 includes a bottom key bracket 311, a bottom key cap 313, a first key A and a second key B; and the bottom key bracket 311 is fixed at the bottom of the barrel body 11, and the first key A and the second key B are fixed on the bottom key bracket 311 in tandem. The bottom key cap 313 is arranged on the first key A and the second key B in a covering manner, and is connected with the bottom key bracket 311, and further the first key A is pressed through pressing the front part of the bottom key cap 312, and the second key B is pressed through pressing the rear part of the bottom key cap 312. Since the first key A and the second key B are connected with the master control circuit 41, the luminous power of the lamp can be regulated through pressing the front part or rear part of the bottom key cap 313. The top key group 32 includes a top key bracket 321, a top key 322 and a top key cap 323; the top key bracket 321 is arranged at the top of the barrel body 11, the top key 322 is fixed on the top key bracket 321, the top key cap 323 is arranged on the top key 322 in a covering manner, and is connected with the top key 322. An operating mode of the lamp can be regulated through pressing the top key cap 323.

The switching circuit 42 includes a first group of key activation circuits, a second group of key activation circuits, a third group of key activation circuits, a conductive circuit and a first triode VT3.

The first group of key activation circuits includes a diode D4 and a schottky diode D3 which are in series-opposing connection; a positive electrode end of the diode D4 is connected with the master control circuit 41, and a positive electrode end of the schottky diode D3 is connected with an external power line via the first triode VT3; and the conductive circuit is connected with the positive electrode end of the schottky diode D3, and is connected to the first triode VT3, and the conductive circuit includes a first field-effect transistor Q4, a second field-effect transistor Q10 and a first resistor R25 which are connected in parallel. The second group of key activation circuits includes a diode D6 and a schottky diode D5 which are in series-opposing connection; a positive electrode end of the diode D6 is connected with the master control circuit 41, and a positive electrode end of the schottky diode D5 is connected with an external power line via the first triode VT3. The third group of key activation circuits includes a diode D8 and a schottky diode D7 which are in series-opposing connection; a positive electrode end of the diode D8 is connected with an external power line, and a positive electrode end of the schottky diode D7 is connected with the master control circuit 41 via the first triode VT3. When one of the keys is pressed downwards, one end of the key is connected to a positive electrode end of a diode and a positive electrode end of a schottky diode, and the other end of the key is grounded, so as to send triggering signals to the master control circuit 41.

The circuit for regulating a poly floodlight state 43 includes a DCDC constant current drive circuit, a power regulating circuit for the near-shot lamp bead and a power regulating circuit for the far-shot lamp beads.

The DCDC constant current drive circuit is connected with the master control circuit 41, such that an output current of the circuit for regulating a poly floodlight state 43 keeps constant; a negative electrode end of the near-shot lamp bead is connected to the DCDC constant current drive circuit, the multiple far-shot lamp beads are connected in series with each other, and positive electrode ends of the far-shot lamp beads at one side in the far-shot lamp beads which are connected in series are connected to the DCDC constant current drive circuit; the power regulating circuit for the near-shot lamp bead includes a first filter circuit, a third field-effect transistor Q6 and a fourth field-effect transistor Q7; an input end of the first filter circuit is connected with the first PWM output end of the master control circuit 41, so as to receive signals for regulating a poly floodlight state of the master control circuit 41; a grid of the third field-effect transistor Q6 and a grid of the fourth field-effect transistor Q7 are both connected with an output end of the first filter circuit; a drain of the third field-effect transistor Q6 and a drain of the fourth field-effect transistor Q7 are both connected with a negative electrode end of the near-shot lamp bead; and a source of the third field-effect transistor Q6 and a source of the fourth field-effect transistor Q7 are both grounded. Wherein, the first filter circuit is composed of a filter resistor R30, and a filter capacitor C31 and a filter capacitor C30 which are respectively arranged at two ends of the filter resistor R30.

The power regulating circuit for the near-shot lamp bead includes a second filter circuit, a fifth field-effect transistor Q8 and a sixth field-effect transistor Q9; an input end of the second filter circuit is connected with the second PWM output end of the master control circuit 41, so as to receive signals for regulating a poly floodlight state of the master control circuit 41; a grid of the fifth field-effect transistor Q8 and a grid of the sixth field-effect transistor Q9 are both connected with an output end of the second filter circuit; a drain of the fifth field-effect transistor Q8 and a drain of the sixth field-effect transistor Q9 are both connected with a negative electrode end of the far-shot lamp beads at the other side of the far-shot lamp beads which are connected in series; and a source of the fifth field-effect transistor Q8 and a source of the sixth field-effect transistor Q9 are both grounded. Wherein, the second filter circuit is composed of a filter resistor R30_1, and a filter capacitor C31_1 and a filter capacitor C30_1 which are respectively arranged at two ends of the filter resistor R30_1.

Wherein, the DCDC constant current drive circuit includes a current monitoring chip U2, a second triode VT1, a seventh field-effect transistor Q3 and a power management chip U1.

A base of the second triode VT1 is connected with the master control circuit 41, to acquire activation signals of a special mode. A collector of the second triode VT1 is connected with an input/output end Sense+ of the current monitoring chip U2 via a resistor R8 and a resistor R7; and an emitter of the second triode VT1 is grounded. A grid of the seventh field-effect transistor Q3 is connected to a connecting end of the resistor R8 and the resistor R7; a source of the seventh field-effect transistor Q3 is connected with the input/output end Sense+ of the current monitoring chip U2 via a resistor R6; a drain of the seventh field-effect transistor Q3 is connected to the power regulating circuit for the near-shot lamp bead and the power regulating circuit for the far-shot lamp beads, and the drain of the seventh field-effect transistor Q3 is connected with the master control circuit 41 via a capacitor C5, a resistor R3 and a resistor R2; a grounded capacitor C4 and a resistor R4 are also connected in parallel between the capacitor C5 and the resistor R3, and a grounded C3 is further connected between the resistor R3 and the resistor R2. A resistor R5 is also connected in parallel between the input/output end Sense+ of the current monitoring chip U2 and the drain of the seventh field-effect transistor Q3. An input/output end VCC of the current monitoring chip U2 is grounded via a capacitor C17. An input/output end OUT of the current monitoring chip U2 is also connected with the master control circuit 41 via the capacitor C5, the resistor R3 and the resistor R2, and the input/output end OUT of the current monitoring chip U2 is connected with an input/output end FB of the power management chip U1. An input/output end CE of the power management chip U1 is connected with the master control circuit 41, and is grounded via a resistor R1. An input/output end VDD of the power management chip U1 is connected with a circuit voltage via a resistor R23. An input/output end EXT of the power management chip U1 is connected with a power voltage via an eighth field-effect transistor Q1 and a ninth field-effect transistor Q2 which are connected in parallel and via an inductor L1, and the input/output end EXT of the power management chip U1 also feeds back signals to the input/output end Sense+ of the current monitoring chip U2 through a third diode D1 via the eighth field-effect Q1 transistor and the ninth field-effect transistor Q2 which are connected in parallel.

In one embodiment, the circuit component 4 is further provided with a wireless receiving circuit 45; and the wireless receiving circuit 45 includes a radio frequency transceiver chip and a transceiver antenna. An input/output end LDO_IN of the radio frequency transceiver chip is connected with a circuit voltage via a resistor R40, and a connecting end between the input/output end LDO_IN of the radio frequency transceiver chip and the voltage dropping resistor R40 is also grounded via a filter circuit which is composed of a capacitor C40 and a capacitor C41, to acquire an operating voltage. An input/output end LDO_OUT of the radio frequency transceiver chip is grounded via a filter circuit composed of a capacitor C42 and a capacitor C43. An input/output end XTALO of the radio frequency transceiver chip is connected with an input/output end XTALI of the radio frequency transceiver chip via a crystal oscillating circuit, and the crystal oscillating circuit includes a crystal oscillator and a load capacitor C46 and a load capacitor C47 which are connected at two ends of the crystal oscillator. An input/output end MOSI and an input/output end MISO of the radio frequency transceiver chip are connected with the master control circuit 41, so as to send or acquire signals to the master control circuit 41. An input/output end ANTb of the radio frequency transceiver chip is connected with the transceiver antenna via an inductor L2, and a capacitor C44 and a capacitor C45 are respectively connected at two ends of the inductor L2, to realize interaction with external wireless transmitting circuit.

In one embodiment, the lamp is supplied with power through an external power supply. The lamp further includes a USB transmission line 19. The circuit component 4 further includes a USB interface circuit 46 and a charging control circuit 47. The barrel body 11 is provided with a USB interface, and the USB transmission line 19 is connected with the USB interface circuit 46 through the USB interface. The charging control circuit 47 is connected with the master control circuit 41, so as to control an incoming voltage from the USB interface circuit 46 through the master control circuit 41. The USB interface circuit 46 includes a resistor R17, a resistor R18, a resistor R19 and a resistor R20; one end of the resistor R18 is connected with a circuit voltage, another end of the resistor R18 is connected with a DATA+ pin of the USB interface, and another end of the resistor R18 is further grounded via the resistor R17. One end of the resistor R20 is connected with the master control circuit 41, another end of the resistor R20 is connected with a DATA− pin of the USB interface, and another end of the resistor R20 is further grounded via the resistor R19. The charging control circuit 47 includes a resistor R16, a resistor R15, a triode VT2, a resistor R13 and a resistor R14. A collector of the triode VT2 is connected to a power voltage via the resistor R15 and resistor R16. A base of the triode VT2 is connected with the master control circuit 41 via the resistor R13, and the base of the triode VT2 is also grounded via the resistor R14. An emitter of the triode VT2 is grounded.

What is described specifically below is how to realize regulation of a poly floodlight state of a light emitting component 2 through adjusting luminous power of the far-shot lamp beads and the near-shot lamp bead: (1) The light emitting component 2 is regulated from a floodlight state to a light focusing state.

Operating signals are sent to the master control circuit 41 through pressing the bottom key 31 or the top key 32, and then the master control circuit 41 is triggered to operate. Afterwards, the front part of the bottom key, namely, the first key, is pressed for a long time, then the master control circuit 41 outputs two paths of PWM signals through corresponding input/output end after receiving triggering signals. Wherein, after being processed by the filter circuit which is composed of the resistor R31, the capacitor C31, the resistor R30 and the capacitor C30, the first path of PWM signals act on the third field-effect transistor Q6 and the fourth field-effect transistor Q7. Through changing an operating state of the third field-effect transistor Q6 and the fourth field-effect transistor Q7, the current flowing through the third field-effect transistor Q6 and the fourth field-effect transistor Q7 is reduced, and further output power of the near-shot lamp bead is reduced, thereby gradually lowering brightness of the near-shot lamp bead. Wherein, after being processed by the filter circuit which is composed of the resistor R31_1, the capacitor C31_1, the resistor R30_1 and the capacitor C30_1, the second path of control signals act on the fifth field-effect transistor Q8 and the sixth field-effect transistor Q9. Through changing an operating state of the fifth field-effect transistor Q8 and the sixth field-effect transistor Q9, the current flowing through the fifth field-effect transistor Q8 and the sixth field-effect transistor Q9 is increased, and further output power of four far-shot lamp beads is increased, thereby gradually increasing brightness of the far-shot lamp beads, and realizing regulation of light beams from a floodlight state to a light focusing state in effect. The key is released when a floodlight state of light beams is adjusted to a degree with which users are satisfied, then the output state is fixed, and the regulating process of a floodlight state is completed.

(2) The Light Emitting Component 2 is Regulated from a Light Focusing State to a Floodlight State.

Operating signals are sent to the master control circuit 41 through pressing the bottom key 31 or the top key 32, then the master control circuit 41 is triggered to operate. Afterwards, the rear part of the bottom key, namely, the second key, is pressed for a long time, then the master control circuit 41 outputs two paths of PWM signals through corresponding input/output end after receiving triggering signals. Wherein, after being processed by the filter circuit which is composed of the resistor R31, the capacitor C31, the resistor R30 and the capacitor C30, the first path of PWM signals act on the third field-effect transistor Q6 and the fourth field-effect transistor Q7. Through changing an operating state of the third field-effect transistor Q6 and the fourth field-effect transistor Q7, the current flowing through the third field-effect transistor Q6 and the fourth field-effect transistor Q7 is increased, and further output power of the near-shot lamp bead is increased, thereby gradually increasing brightness of the near-shot lamp bead. Wherein, after being processed by the filter circuit which is composed of the resistor R31_1, the capacitor C31_1, the resistor R30_1 and the capacitor C30_1, the second path of control signals act on the fifth field-effect transistor Q8 and the sixth field-effect transistor Q9. Through changing an operating state of the fifth field-effect transistor Q8 and the sixth field-effect transistor Q9, the current flowing through the fifth field-effect transistor Q8 and the sixth field-effect transistor Q9 is reduced, and further output power of four far-shot lamp beads is reduced, thereby gradually lowering brightness of the far-shot lamp beads, and realizing regulation of light beams from a light focusing state to a floodlight state in effect. The key is released when a floodlight state of light beams is adjusted to a degree with which users are satisfied, then the output state is fixed, and the regulating process of a floodlight state is completed.

Compared with the known art, in embodiments of the present invention, through designing a near-shot lamp bead, multiple far-shot lamp beads and a hardware circuit, under the premise of ensuring leakproofness and stability of lamps, a luminous power of a light emitting component can be conveniently regulated through pressing keys, thereby conveniently realizing regulation of the poly floodlight state. Further, the total output power of a hardware circuit designed in embodiments of the present invention is unchanged, thereby ensuring that the total output lumen is unchanged.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

What is claimed:

1. A lamp comprising: a barrel, a light emitting component, a switching assembly and a circuit component; wherein the light emitting component and the circuit component are arranged inside the barrel, the switching assembly is embedded on the barrel, and the light emitting component and the switching assembly are both electrically connected with the circuit component;

the light emitting component includes a lamp panel group, multiple far-shot lamp beads and a near-shot lamp bead; the multiple far-shot lamp beads are arranged on the lamp panel group, and are uniformly distributed on the periphery of the light panel group; and the near-shot lamp bead is arranged at the center of the lamp panel group;

the circuit component comprises a master control circuit, a switching circuit and a circuit for regulating a poly floodlight state; the switching circuit is connected with the switching assembly and the master control circuit, and transmits triggering signals, wherein the switching assembly is pressed down or released, to the master control circuit; and the circuit for regulating a poly floodlight state is connected with the master control circuit and the light emitting component, and regulates luminous power of the far-shot lamp beads and the near-shot lamp bead in the light emitting component.

2. The lamp of claim 1, wherein the switching assembly comprises at least two keys, and the switching circuit comprises at least two groups of key activation circuits, a conductive circuit and a first triode;

each group of key activation circuits corresponds to one key, and each group of key activation circuits comprises a first diode and a first schottky diode which are in series-opposing connection; a positive electrode end of the first diode is connected with the master control circuit, and a positive electrode end of the first schottky diode is connected with an external power line via the first triode; the conductive circuit is connected with the positive electrode end of the first schottky diode, and is connected to the first triode, and the conductive circuit comprises a first field-effect transistor, a second field-effect transistor and a first resistor which are connected in parallel; when one of the keys is pressed down, one end of the key is connected to a negative electrode end of the first diode and a negative electrode end of the first schottky diode, and another end of the key is grounded, so as to send triggering signals to the master control circuit.

3. The lamp of claim 1, wherein the circuit for regulating a poly floodlight state comprises a DCDC constant current drive circuit, a power regulating circuit for the near-shot lamp bead and a power regulating circuit for the far-shot lamp beads;

the DCDC constant current drive circuit is connected with the master control circuit, such that an output current of the circuit for regulating a poly floodlight state keeps constant; a positive electrode end of the near-shot lamp bead is connected to the DCDC constant current drive circuit, the multiple far-shot lamp beads are connected in series with each other, and a positive electrode end of one of the far-shot lamp beads is connected to the DCDC constant current drive circuit;

the power regulating circuit for the near-shot lamp bead comprises a first filter circuit, a third field-effect transistor and a fourth field-effect transistor; an input end of the first filter circuit is connected with a first PWM output end of the master control circuit, so as to receive signals for regulating a poly floodlight state of the master control circuit; a grid of the third field-effect transistor and a grid of the fourth field-effect transistor are both connected with an output end of the first filter circuit; a drain of the third field-effect transistor and a drain of the fourth field-effect transistor are both connected with a negative electrode end of the near-shot lamp bead; and a source of the third field-effect transistor and a source of the fourth field-effect transistor are both grounded;

the power regulating circuit for the far-shot lamp beads comprises a second filter circuit, a fifth field-effect transistor and a sixth field-effect transistor; an input end of the second filter circuit is connected with a second PWM output end of the master control circuit, so as to receive signals for regulating a poly floodlight state of the master control circuit; a grid of the fifth field-effect transistor and a grid of the sixth field-effect transistor are both connected with an output end of the second filter circuit; a drain of the fifth field-effect transistor and a drain of the sixth field-effect transistor are both connected with a negative electrode end of the far-shot lamp beads; and a source of the fifth field-effect transistor and a source of the sixth field-effect transistor are both grounded.

4. The lamp of claim 1, wherein the lamp panel group comprises a first light panel and a second light panel, an accommodation groove is arranged in a center of the first light panel; the second light panel is arranged inside the accommodation groove; the multiple far-shot lamp beads are uniformly distributed on the periphery of the first light panel, and the near-shot lamp bead is arranged in a center of the second light panel.

5. The lamp of claim 1, wherein the barrel comprises a barrel body, an inner bracket, a rear cover, a fixed support, a support hinge, a lens and a head compression ring; the inner bracket is arranged inside the barrel body; the circuit component is fixed on the inner bracket, and is arranged behind the barrel body; the rear cover is arranged at a rear end of the barrel body, and is fixedly connected with the inner bracket; the fixed bracket is fixed on the barrel body via the bracket hinge, and is arranged at a rear end of the rear cover; the light panel group is arranged on the inner bracket, and is located in a middle part of the barrel body; the lens is fixedly connected with the inner bracket, and is located at a front part of the barrel body; and the head compression ring is fixed on a front end of the barrel body in a rotating manner.

6. The lamp of claim 5, wherein the switching assembly comprises a bottom key group arranged at the bottom of the barrel body, and the bottom key group has a first key and a second key, which are connected with the switching circuit, at the front part and the rear part of the bottom key group respectively.

7. The lamp of claim 5, further comprising a USB transmission line; the circuit component further comprises a USB interface circuit and a charging control circuit; the barrel body has a USB interface, and the USB transmission line is connected with the USB interface circuit through the USB interface; and the charging control circuit is connected with the master control circuit.

8. The lamp of claim 7, wherein the USB interface circuit comprises resistor R17, a resistor R18, a resistor R19 and a resistor R20; one end of the resistor R18 is connected with a circuit voltage, another end of the resistor R18 is connected with a DATA+ pin of the USB interface, and another end of the resistor R18 is further grounded via the resistor R17; one end of the resistor R20 is connected with the master control circuit, another end of the resistor R20 is connected with a DATA− pin of the USB interface, and another end of the resistor R20 is further grounded via the resistor R19; the charging control circuit comprises a resistor R16, a resistor R15, a triode VT2, a resistor R13 and a resistor R14; a collector of the triode VT2 is connected to a power voltage via the resistor R15 and resistor R16; a base of the triode VT2 is connected with the master control circuit via the resistor R13, and the base of the triode VT2 is also grounded via the resistor R14; an emitter of the triode VT2 is grounded.

9. The lamp of claim 1, wherein the circuit component further comprises a wireless receiving circuit; and the master control circuit wirelessly communicates with an external wireless transmitting circuit through the wireless receiving circuit.

10. The lamp of claim 9, wherein the wireless receiving circuit comprises a radio frequency transceiver chip and a transceiver antenna; an input/output end LDO_IN of the radio frequency transceiver chip is connected with a circuit voltage via a resistor R40, and a connecting end between the input/output end LDO_IN of the radio frequency transceiver chip and the voltage dropping resistor R40 is also grounded via a filter circuit which is composed of a capacitor C40 and a capacitor C41; an input/output end LDO_OUT of the radio frequency transceiver chip is grounded via a filter circuit composed of a capacitor C42 and a capacitor C43; an input/output end XTALO of the radio frequency transceiver chip is connected with an input/output end XTALI of the radio frequency transceiver chip via a crystal oscillating circuit, and the crystal oscillating circuit comprises a crystal oscillator and a load capacitor C46 and a load capacitor C47 which are connected at two ends of the crystal oscillator; an input/output end MOSI and an input/output end MISO of the radio frequency transceiver chip are connected with the master control circuit; an input/output end ANTb of the radio frequency transceiver chip is connected with the transceiver antenna via an inductor L2, and a capacitor C44 and a capacitor C45 are respectively connected at two ends of the inductor L2.

* * * * *